US005176017A

United States Patent [19]

Tokai

[11] Patent Number: 5,176,017

[45] Date of Patent: Jan. 5, 1993

[54] TOOL POSITION CONTROLLER OF BENDING MACHINE

[75] Inventor: Shigeru Tokai, Komatsu, Japan

[73] Assignee: Kabushiki Kaisha Komatsu Seisakusho, Japan

[21] Appl. No.: 543,836

[22] PCT Filed: Nov. 15, 1989

[86] PCT No.: PCT/JP89/01160

§ 371 Date: Sep. 14, 1990

§ 102(e) Date: Sep. 14, 1990

[87] PCT Pub. No.: WO90/05599

PCT Pub. Date: May 31, 1990

[30] Foreign Application Priority Data

Nov. 15, 1988 [JP] Japan ..... 63-148011

[51] Int. Cl.[5] ..... B21D 5/04

[52] U.S. Cl. ..... 72/7; 72/316; 72/322; 72/389

[58] Field of Search ..... 72/389, 320, 321, 322, 72/311, 316, 10, 9, 12, 21, 702, 37, 7

[56] References Cited

U.S. PATENT DOCUMENTS

| | | | |
|---|---|---|---|
| 4,331,018 | 5/1982 | Doyle | 72/389 |
| 4,356,716 | 11/1982 | Aschauer | 72/322 |
| 4,658,624 | 4/1987 | Ridgway et al. | 72/316 |
| 4,658,625 | 4/1987 | Koyama et al. | 72/316 |
| 4,966,029 | 10/1990 | Zbornik | 72/389 |
| 5,007,264 | 4/1991 | Haack | 72/322 |

FOREIGN PATENT DOCUMENTS

| | | | |
|---|---|---|---|
| 52-02431 | 6/1977 | Japan . | |
| 53-35031 | 9/1978 | Japan . | |
| 54-417 | 1/1979 | Japan . | |
| 0158527 | 7/1987 | Japan | 72/389 |

*Primary Examiner*—David Jones
*Attorney, Agent, or Firm*—Ronald P. Kananen

[57] ABSTRACT

This invention relates to a tool position controller of a bending machine which can control a bending angle at an arbitrary portion during a bending work. The upper part of this controller is divided into two plates (5*a*,5*a*) by groove in a longitudinal direction. The controller includes a die (5) which has a reversed plate support (9) fitted inside a groove (5*b*) defined between these two plates, die push-up means (10, 11, 12) disposed at at least one position in the longitudinal direction of the die below the die, and feed quantity control means (13, 14, 15) for controlling the feed quantity of the die push-up means on the basis of a machining condition that has been in advance inputted. A work (40) is held under pressure between a punch (8) fitted to the tip of a ram (7) moved vertically by a pressure holding cylinder (6) and the reversed plate support (9) described above and is subjected to the bending work when the die is pushed up through the push-up means.

7 Claims, 8 Drawing Sheets

FREQUENCY VOLTAGE CONVERTER
PULSE CONDITIONER
DEVIATION COUNTER
D/A CONVERTER
NC UNIT
CENTRAL PROCESSING UNIT
1: BENDING ANGLE OF PRODUCT; A
2: THICKNESS OF PRODUCT; T
3: MATERIAL OF PRODUCT: MAT'L
4: GROOVE WIDTH OF DIE: V
5: RADIUS R OF PUNCH: PR
6: LENGTH OF PRODUCT; L
7: LEG LENGTH OF PRODUCT; H

TOOL POSITION CONTROLLER OF BENDING MACHINE

FIELD OF THE INVENTION

The present invention relates to a bending machine such as a press brake and the like, and more particularly to a tool position controller of the bending machine for controlling a bending angle of a desired portion of a workpiece or elongated sheet metal during a bending operation performed on the bending machine.

DESCRIPTION OF THE PRIOR ART

Hitherto, in case that an elongated sheet metal or workpiece must be bent, a bending machine such as a press brake is employed to perform a bending operation of the workpiece.

Such bending machine is provided with elongated tools comprising an elongated punch and an elongated die between which the sheet metal or workpiece is clamped under pressure and then subjected to the bending operation thereof. Hitherto, a large variety of apparatuses and methods, which compensate for deflections of the tools and control a bending angle of the sheet metal or workpiece during the bending operation thereof on the bending machine, has been proposed.

Included among these conventional apparatuses and methods having been proposed are, for example: an apparatus and a method for compensating for deflections of tools during a bending operation of a workpiece on a bending machine by applying a hydraulic pressure to a plurality of hydraulic cylinders disposed under a die or tool, which hydraulic pressure is so controlled as to correspond to deflections of the tools comprising the die and a punch, the deflections of the tools being detected by strain gages; and others in the prior art disclosed in Japanese Patent Publication Nos. 57-27773, 52-20431, 54-417 and 55-41848.

In the above conventional apparatus and method in which the hydraulic pressure corresponding to the deflections of the tools is applied to the hydraulic cylinders, it is possible to compensate for the deflections of the tools during the bending operation of the workpiece on the bending machine. However, each of the hydraulic cylinders employed in the conventional apparatus and method does not perform its own tool position control, and, therefore, can not control a bending angle of the workpiece during the bending operation thereof.

On the other hand, in case of a bending tool disclosed in the Japanese Patent Publication No. 57-27773, it is not possible for the bending tool to perform a continuous fine control of a bending angle of a desired portion of the workpiece under pressure. Consequently, in cases where the bending angle of the workpiece varies locally during the bending operation of the workpiece performed by such bending tool, it is impossible for the bending tool to compensate for such local variations in bending angle of the workpiece under pressure. On the other hand, each of the others in the prior art disclosed in the Japanese Patent Publication Nos. 52-20431 and 54-417 is a mechanical press brake in which: a ram is moved up and down by means of a link mechanism; and a die is pushed up by a hydraulic cylinder to control a bending angle of a workpiece. However, such a mechanical press brake does not fulfill the function of position control, and, therefore, cannot compensate for variations in the bending angle of the workpiece due to various factors. In addition, since the mechanical press brake is of a type controlling the pressure of the hydraulic cylinder, a bending pressure applied to the workpiece is dispersed. Consequently, the mechanical press brake cannot perform an effective compensation for the variations in bending angle of the workpiece.

SUMMARY OF THE INVENTION

Under such circumstances, the present invention was made. Therefore, it is an object of the present invention to provide a tool position controller of a bending machine for controlling a bending angle of a desired portion of a workpiece or elongated sheet metal during a bending operation thereof performed on the bending machine.

The above object of the present invention is accomplished in accordance with a first aspect of the present invention by providing:

A tool position controller of a bending machine comprising:

a die an upper portion of which is divided into two pieces along a longitudinal direction of the die to form a groove between the two pieces;

a die push-up means provided under the die in a position or in each of positions along the longitudinal direction of the die;

and a feed quantity control means for controlling a feed quantity of the die push-up means on the basis of working conditions previously inputted to the tool position controller;

whereby a workpiece or sheet metal is clamped between a punch and a counter sheet-metal support under pressure, the counter sheet-metal support being interposed between the two pieces of the die, the punch being fixedly mounted on a front end of a ram which is moved up and down by a pressure applying/holding hydraulic cylinder, and then the die is lifted by the die push-up means so that the workpiece is subjected to a bending operation thereof on the bending machine.

In addition, the above object of the present invention is accomplished in accordance with a second aspect of the present invention by providing:

The tool position controller of the bending machine as set forth in the first aspect of the present invention, wherein:

the die push-up means comprises:

a pair of pins which are connected with the die through a pair of die bases to transmit a pushing-up force to the die;

a height control mechanism for controlling the pins in height, the height control mechanism being provided in lower portions of the pins; and a bending hydraulic cylinder provided with a piston rod connected with a piston which is slidably mounted in a cylinder of the bending hydraulic cylinder so as to be moved up and down, the bending hydraulic cylinder being connected with a lower end of the height control mechanism through the piston rod thereof while controlled in hydraulic pressure applied thereto by the feed quantity control means.

Further, the above object of the present invention is accomplished in accordance with a third aspect of the present invention by providing:

The tool position controller of the bending machine as set forth in the second aspect of the present invention, wherein:

the feed quantity control means comprises:

a servo valve interposed between the bending hydraulic cylinder and a hydraulic pressure supply source;

a feed quantity control screw for operating the servo valve;

a servo motor for rotatably driving the feed quantity control screw; and a control unit for operating the servo motor on the basis of working conditions previously inputted to the control unit.

Furthermore, the above object of the present invention is accomplished in accordance with a fourth aspect of the present invention by providing:

The tool position controller of the bending machine as set forth in the first aspect or the second aspect of the present invention, wherein:

the feed quantity control means comprises:

an electro hydraulic servo valve interposed between the bending hydraulic cylinder and a hydraulic pressure supply source; and a control unit for operating the electro hydraulic servo valve.

Still further, the above object of the present invention is accomplished in accordance with a fourth aspect of the present invention by providing:

The tool position controller of the bending machine as set forth in the first aspect of the present invention, wherein:

the die push-up means comprises:

a pair of pins which are connected with the die through a pair of die bases to transmit a pushing-up force to the die;

a height control mechanism for controlling the pins in height, the height control mechanism being provided in lower portions of the pins; and the feed quantity control means comprises:

an electric servo motor;

a control unit for controlling the electric servo motor;

a recirculating ball nut rotatably driven by the electric servo motor through a pair of bevel gears; and a screw threadably engaged with the recirculating ball nut, the screw being moved up and down as the recirculating ball nut rotates while provided with an upper end abutting on a lower end of the height control mechanism.

In accordance with the present invention having the above aspects, working conditions such as the bending angle of the workpiece or sheet metal, the thickness of the workpiece, the material of the workpiece and the like working conditions are previously inputted to the tool position controller of a bending machine, so that the feed quantity of the die push-up means is automatically determined, the die push-up means being provided in a portion or in a plurality of portions along the longitudinal direction of the tool. Consequently, it is possible for the tool position controller of the present invention to produce a product of high precision entirely free from variations of local bending angles and cambers.

In addition, it is also possible for the tool position controller of the present invention to control a bending angle of a desired portion the workpiece or sheet metal during the bending operation thereof on the bending machine. Consequently, the tool position controller of the present invention can compensate for variations of the bending angle of the workpiece during the bending operation thereof. Further, in accordance with the present invention, the workpiece or sheet metal is clamped between the punch and the counter sheet-metal support of the bending machine under pressure, and then bent through a desired bending angle, so that there is no fear that flex cracks appear in the workpiece or sheet metal and also there is no fear that cambers appear in the bent workpiece or completed product.

The above object, additional objects, additional aspects and advantages of the present invention will be clarified to those skilled in the art hereinbelow with reference to the following description and accompanying drawings illustrating preferred embodiments of the present invention according to principles of the present invention.

DESCRIPTION OF THE PREFERRED EMBODIMENTS

Figure 1:
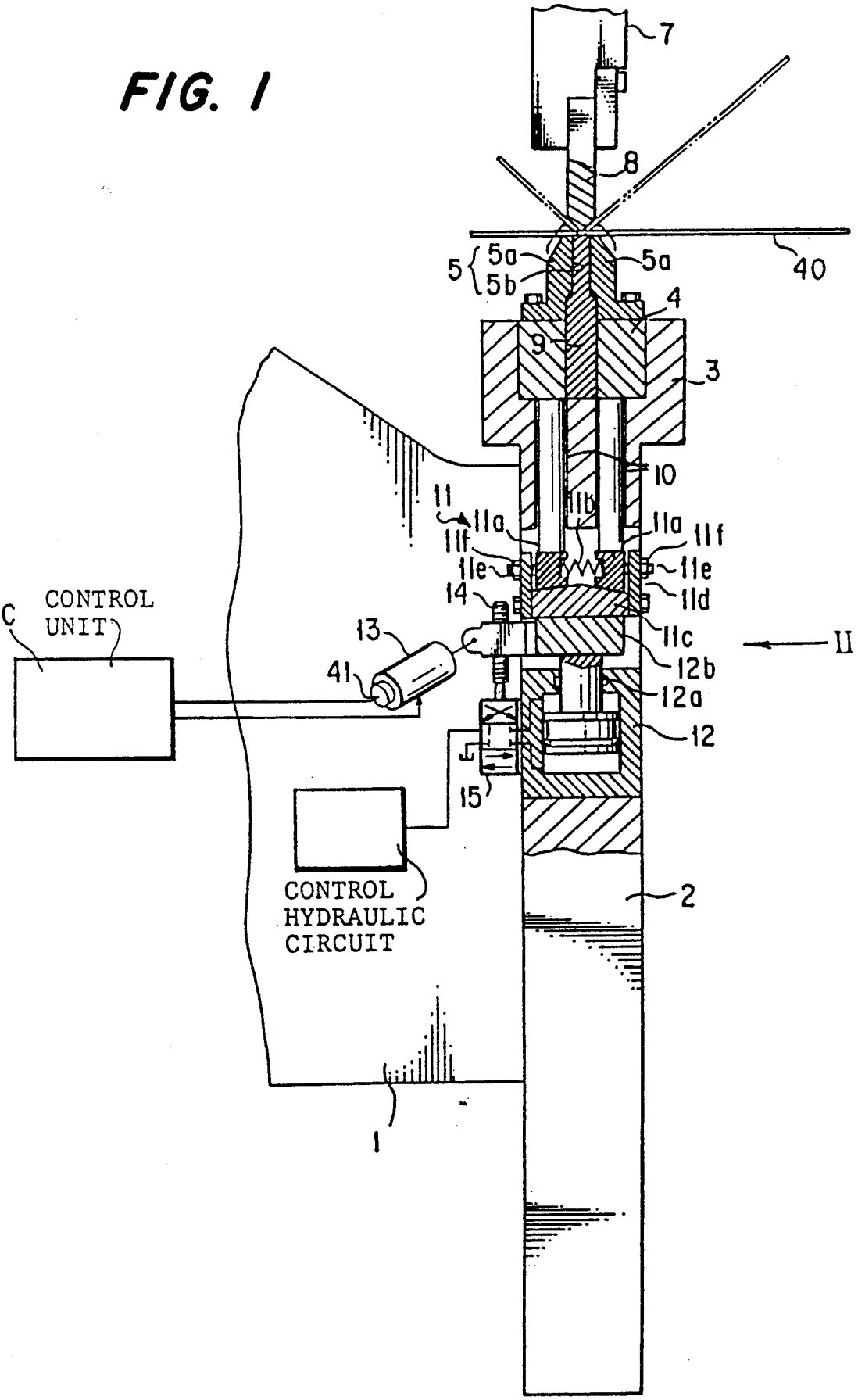
FIG. 1 is a schematic longitudinal sectional view of a first embodiment of the present invention.
Figure 2:
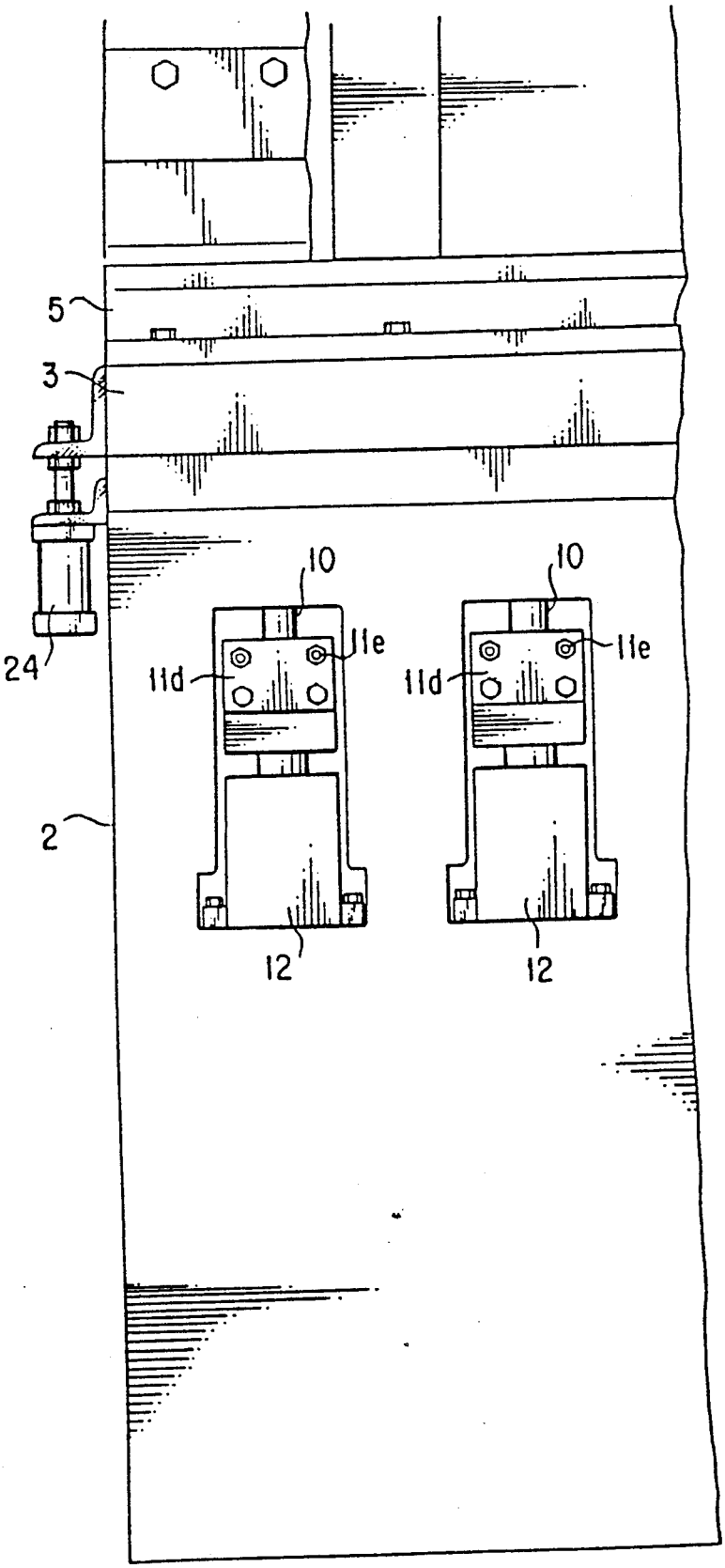
FIG. 2 is a side view of the first embodiment of the present invention, looking in the direction of an arrow shown in FIG. 1.

Hereinbelow, several preferred embodiments of the present invention will be described in detail with reference to the accompanying drawings.

Now, a first embodiment of the present invention will be described with reference to FIGS. 1 to 5.

In the drawings: the reference numeral 1 denotes a main body of a bending machine in which a table or die holder 3 is provided in an upper portion of a lower beam 2. A movable die 5 is mounted in the table or die holder 3 through a die base 4. A punch 8 is provided over the movable die 5, while mounted on a ram 7. The ram 7 is moved up and down by a pressure applying-/holding hydraulic cylinder 6 (see FIG. 3).

The movable die 5 has a construction in which an upper portion of the movable die is divided into two upper pieces 5*a*, 5*a* interposed between which is a groove 5*b* extending in parallel with a longitudinal direction of the upper piece 5*a* of the movable die 5. A stationary counter sheet-metal support 9 is fixedly mounted on the lower beam 2, while received in the groove 5*b* formed between the upper pieces 5*a*, 5*a* of the movable die 5. The movable die 5 is fixedly mounted on a pair of the die base 4 under each of which is provided a pin 10 which is moved up and down in operation.

A lower end of each of the pins 10 abuts on an upper surface of an upper wedge 11*a* of a pin height control mechanism 11.

The pin height control mechanism 11 is divided into two groups, i.e., the upper wedges 11*a* and a lower wedge 11*c*. A compression spring 11*b* urges the upper wedges 11*a* away from each other. The lower wedge 11*c* assumes a mountain-like shape a central portion of which forms the highest portion of the lower wedge. Fixedly mounted on the opposite side surfaces of the lower wedge 11*c* are side plates 11*d* in each of which a plurality of adjusting screws 11*e* are disposed in a plurality of portions of each of the side plates 11*d*. The movable die 5 is adjusted in height relative to the stationary counter sheet-metal support 9 by adjusting a distance between the upper wedges 11*a* of the pin height control mechanism 11, the distance being adjusted by the adjusting screws 11*e*. After completion of adjustment of each of the adjusting screws 11*e*, each of the screws 11*e* is locked in place on the side plate 11*d* by fastening a locking nut 11*f* (see FIG. 5).

On the other hand, a lower portion of the lower wedge 11*c* of the pin height control mechanism 11 is supported by an upper end of a piston rod 12*a* of a bending hydraulic cylinder 12 through a supporting member 12*b*, the bending hydraulic cylinder being provided in the lower beam 2. It is also possible to employ a plurality of the bending hydraulic cylinders 12 which are disposed in a plurality of portions of the lower beam 2, the portions being spaced apart from each other in a longitudinal direction of the lower beam 2.

In the supporting member 12*b* is provided a feed quantity control screw 14. The control screw 14 is rotatably driven by a servo motor 13 so as to be adjustable in height, the servo motor 13 being provided in each of the bending hydraulic cylinders 12. The control screw 14 operates a mechanical servo valve 15 provided in each of the bending hydraulic cylinders 12.

Figure 3:
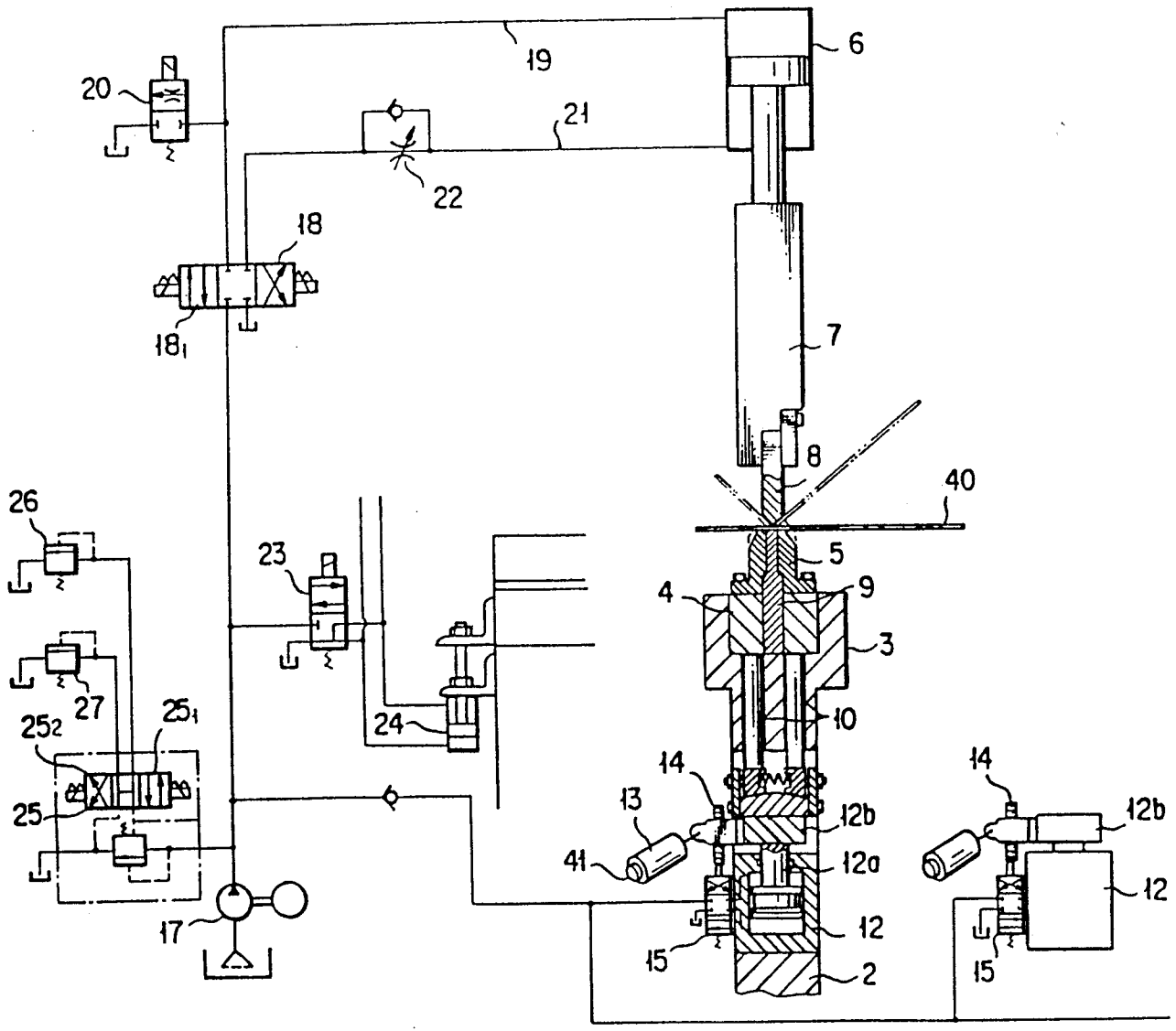
FIG. 3 is a hydraulic circuit of the first embodiment of the present invention shown in FIG. 1.
Figure 4:
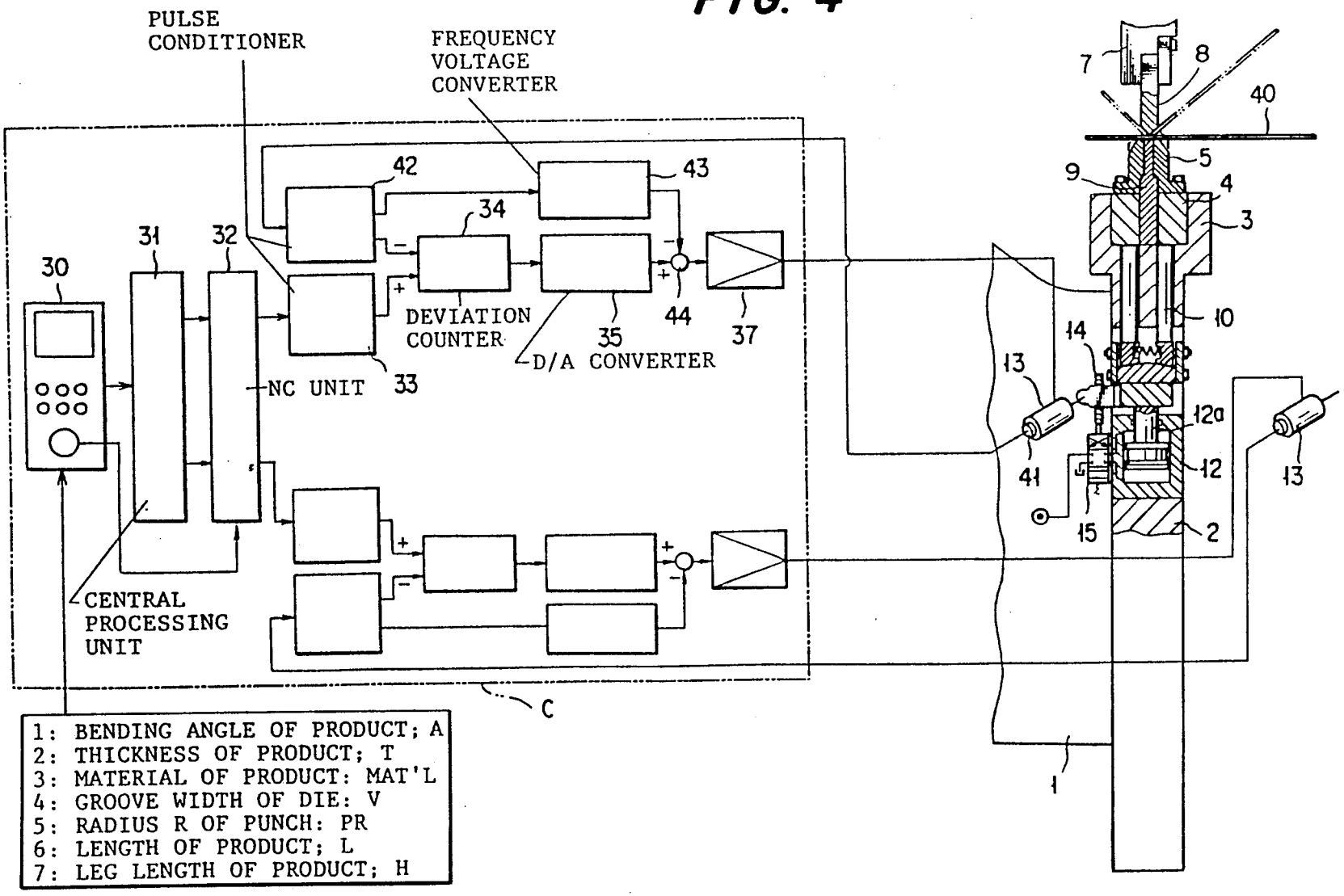
FIG. 4 is a block diagram of a control system of the first embodiment of the present invention shown in FIG. 1.
Figure 5:
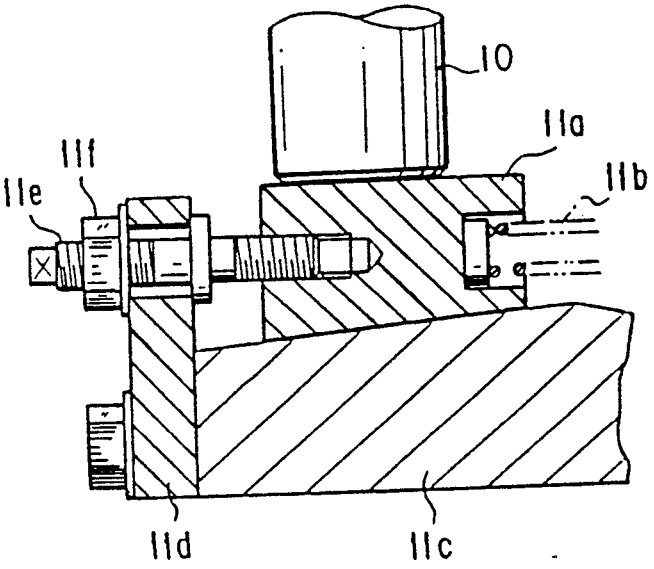
FIG. 5 is a partially enlarged longitudinal sectional view of the height control mechanism.

On the other hand, FIG. 3 shows a hydraulic system for supplying hydraulic pressure to each of the bending hydraulic cylinders 12, in which system the hydraulic pressure supplied from a hydraulic pump 17 is selectively applied to a cap side and a head side of each of the hydraulic cylinders 12. A pressure relief valve 20 is provided in a head-side hydraulic line 19, while a lowering speed control valve 22 is provided in a rod-side hydraulic line 21.

A part of hydraulic pressure developed in the hydraulic pump 17 is supplied to each of the bending hydraulic cylinders 12 through each of the servo valves 15, and further to forced lowering hydraulic cylinders 24 through solenoid controlled valves 23, each of the forced lowering hydraulic cylinders 24 being mounted on a right and a left end portion of the table or die holder 3.

Incidentally, in the drawings: the reference numeral 25 denotes a solenoid controlled valve which selectively operates pressure relief valves 26, 27. The pressure relief valve 26 is employed to set a hydraulic pressure applied to the workpiece or sheet metal through the pressure applying/holding hydraulic cylinder 6. On the other hand, the pressure relief valve 27 is employed to set a hydraulic pressure which is applied to the pressure applying/holding hydraulic cylinder 6 to simply lower and lift its piston but not applied to the workpiece or sheet metal.

Figure 7:
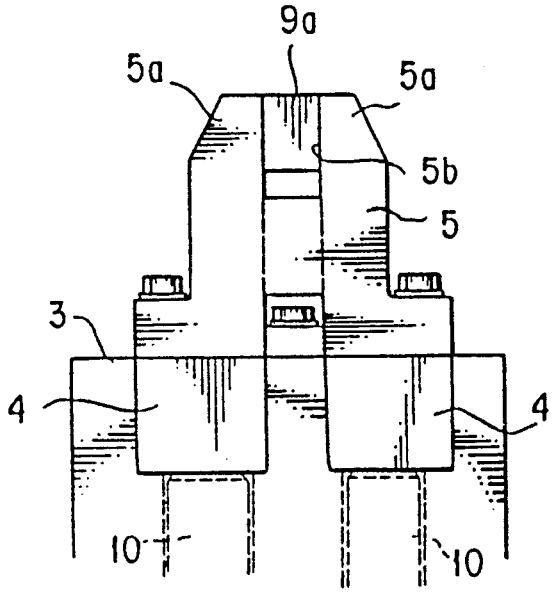
FIGS. 7 and 8 are a partial front and a partial side view of a modification of the die, respectively.
Figure 8:
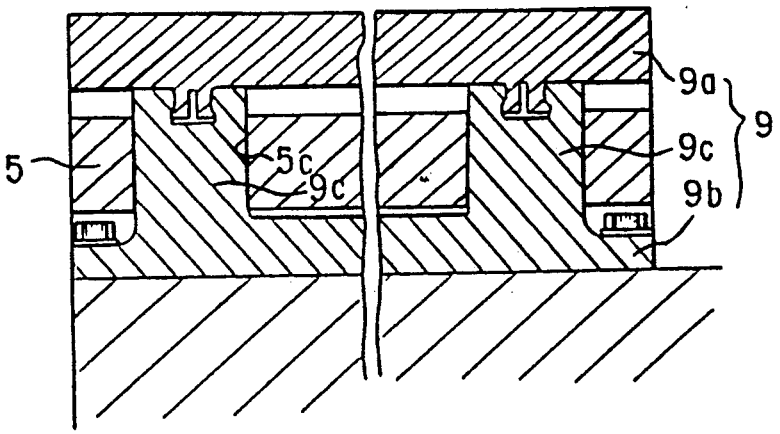

In order to separate the upper pieces 5*a* of the die 5 from each other, the die 5 is previously divided into two pieces 5*a*, 5*a* along its longitudinal direction. However, as shown in FIGS. 7 and 8, it is also possible to integrally construct the die 5. In this case, in such construction of the die 5, the stationary counter sheet-metal support 9 is divided into two pieces, i.e., an upper support member 9*a* and a lower support member 9*b*. The lower support member 9*b* of the stationary counter sheet-metal support 9 is provided with a projection 9*c* which extends upward through an opening 5*c* provided in the groove 5*b* formed between the upper pieces 5*a* of the die 5. The projection 9*c* extended upward from the opening 5*c* is engaged with a lower portion of the upper support member 9*a* of the stationary counter sheet-metal support 9 in an insertion manner.

Figure 6:
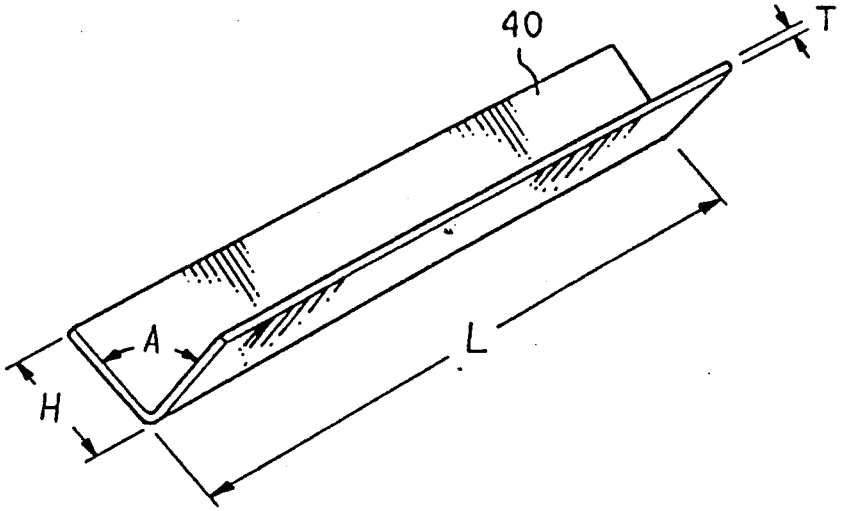
FIG. 6 is a perspective view of the product or workpiece after completion of the bending operation.

Now, operation of the tool position controller of the present invention will be described with reference to the block diagram (shown in FIG. 4) of a control unit C of the tool position controller of the present invention. In case that, a product, for example such as shown in FIG. 6 is produced through a bending operation of a sheet metal on a bending machine, in the first place, the following information is inputted to the control unit C through an operation panel 30:

WORKING CONDITIONS 1. bending angle of a product: A
2. thickness of the product: T
3. material of the product: MAT'L
4. groove width of a die: V
5. radius R of a punch: PR
6. length of the product: L
7. leg length of the product: H After completion of inputting operation of the above information, the controller starts controlling the bending machine to place the solenoid controlled valves 18 and 25 in positions $18_1$ and $25_1$, respectively. As a result, a hydraulic pressure set in the pressure relief valve 26 is applied to the head side of the pressure applying/holding hydraulic cylinder 6 through the solenoid controlled valve 18 to cause the ram to start its lowering motion, so that a front end of the punch 8 mounted on a front end of the ram 7 abuts on an upper surface of a workpiece or sheet metal 40 mounted on the movable die 5, whereby a desired portion of the workpiece or sheet metal 40 to be subjected to a bending operation on the bending machine is clamped between the punch 8 and the stationary counter sheet-metal support 9 under pressure.

On the other hand, in a central processing unit 31 to which the information required in the bending operation of the workpiece of sheet metal 40 is inputted, such information is processed together with various data required in the bending operation. After completion of processing of the information and the various data required in the bending operation of the workpiece or sheet metal 40, the central processing unit 31 issues an output signal to a numerical control (NC) unit 32.

Upon receipt of the output signal issued from the central processing unit 31, the NC unit 32 issues a control signal which is supplied to the servo motor 13 of each of the bending hydraulic cylinders 12 through a pulse conditioner 33, deviation counter 34, digital-to-analog (D/A) converter 35 and an analog amplifier 37.

As a result, on the basis of the control signal issued from the NC unit 32, the servo motor 13 rotatably drives the feed quantity control screw 14 to operate the mechanical servo valve 15 provided in each of the bending hydraulic cylinders 12, so that a hydraulic pressure developed in the hydraulic pump 17 is applied to a bottom side of each of the bending hydraulic cylinders 12 to cause the movable die 5 to move upward by a predetermined feed quantity.

On the other hand, the servo motor is provided with a pulse encoder 41 so that an actual feed quantity of the movable die 5 is fed back to the deviation counter 34 and a frequency voltage converter 43 through another pulse conditioner 42.

The frequency voltage converter 43 is employed to provide a feedback signal of a lifting speed of the movable die 5. Namely, the converter 43 converts the thus inputted signal of the feed quantity of the movable die 5 into a voltage signal which is issued to a comparator 44 in which the voltage signal is compared with an output signal issued from the D/A converter 35, so that the lifting speed of the movable die 5 is compensated to stop the feed of the movable die 5 when the movable die 5 reaches a predetermined level, whereby the workpiece or sheet metal 40 is clamped between the movable die 5 and the punch 8 and bent therebetween through a predetermined angle "A" which is previously inputted.

After completion of the bending operation of the workpiece of sheet metal 40, the solenoid controlled valve 20 is released to permit a pressure oil confined in the head side of the pressure applying/holding hydraulic cylinder 6 to flow out of the cylinder 6. After that, the solenoid controlled valves 18 and 25 are placed in positions $18_2$ and $25_2$, respectively. As a result, a hydraulic pressure which is set through the pressure relief valve 27 is applied to the rod side of the pressure applying/holding hydraulic cylinder 6 so that the ram 7 and the punch 8 are lifted. At the same time, the servo motor 13 reverses to move the feed quantity control screw 14 downward so that the servo valve is operated to apply the hydraulic pressure to the rod side of each of the bending hydraulic cylinders 12.

As a result, the movable die is lowered. At this time, since the solenoid controlled valve 23 is placed in the position $23_1$, the hydraulic pressure is also applied to the rod side of each of the forced lowering hydraulic cylinders 24 so that the movable die 5 is lowered or moved downward by the forced lowering hydraulic cylinders 24.

As described above, the workpiece of sheet metal 40 is bent so that the completed product as shown in FIG. 6 is produced. In addition, it is also possible to modify the bending angle of a desired portion of the workpiece or sheet metal 40 by controlling a feed quantity of each of the bending hydraulic cylinders 12.

Figure 9:
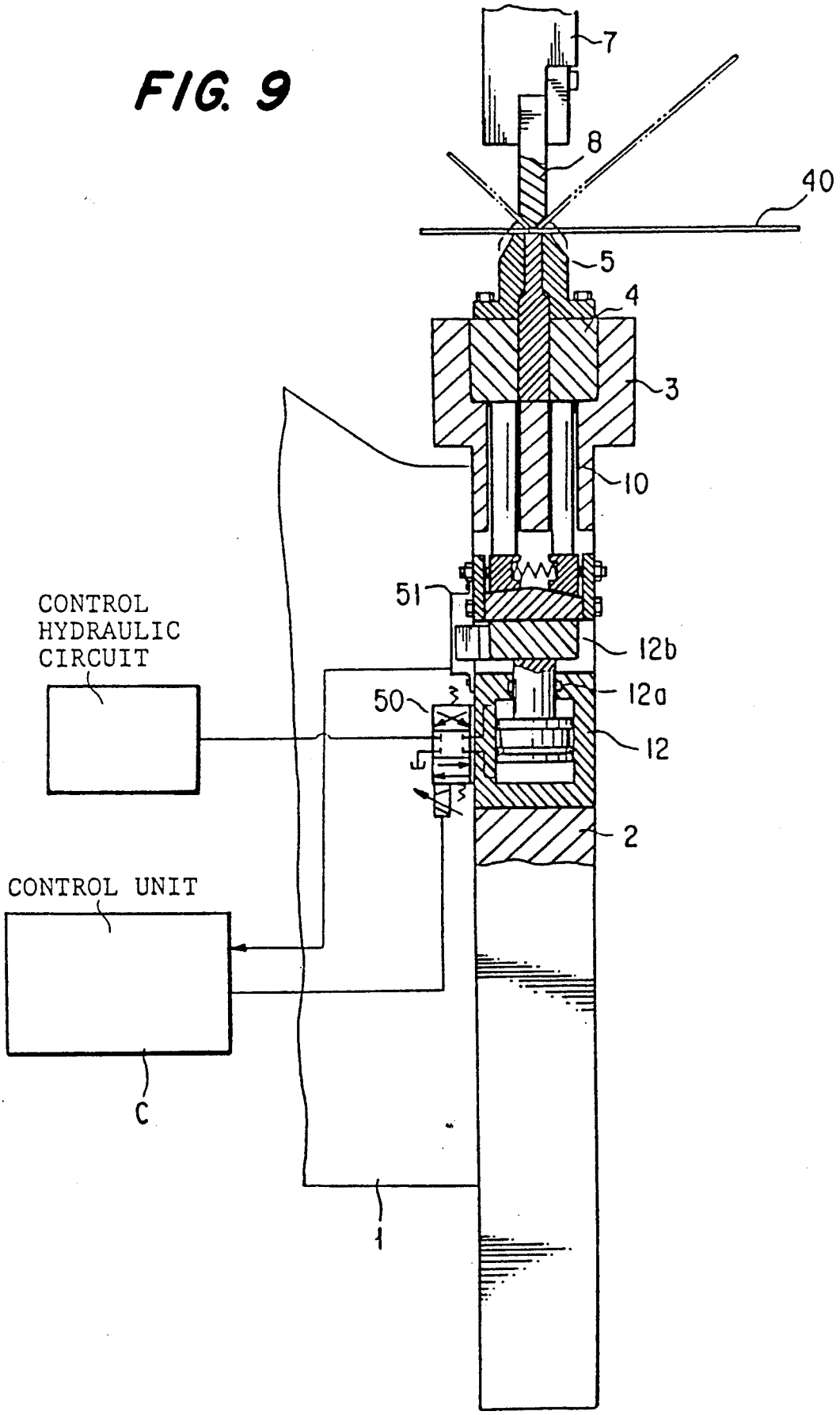
FIGS. 9 and 10 are a schematic longitudinal sectional view of a second embodiment and that of a third embodiment of the present invention, respectively.

Incidentally, in the first embodiment of the present invention described above, the servo valves 15 are operated by the servo motors 13 through the feed quantity control screws 14. However, as shown in a second embodiment of the present invention shown in FIG. 9, it is also possible to directly control each of electro hydraulic servo valves 50 on the basis of a control signal issued from the control unit C. In this case, a feed qantity of the movable die 5 is determined through a linear scale 51 fixedly mounted on the lower beam of the bending machine and fed back to the control unit C.

Figure 10:
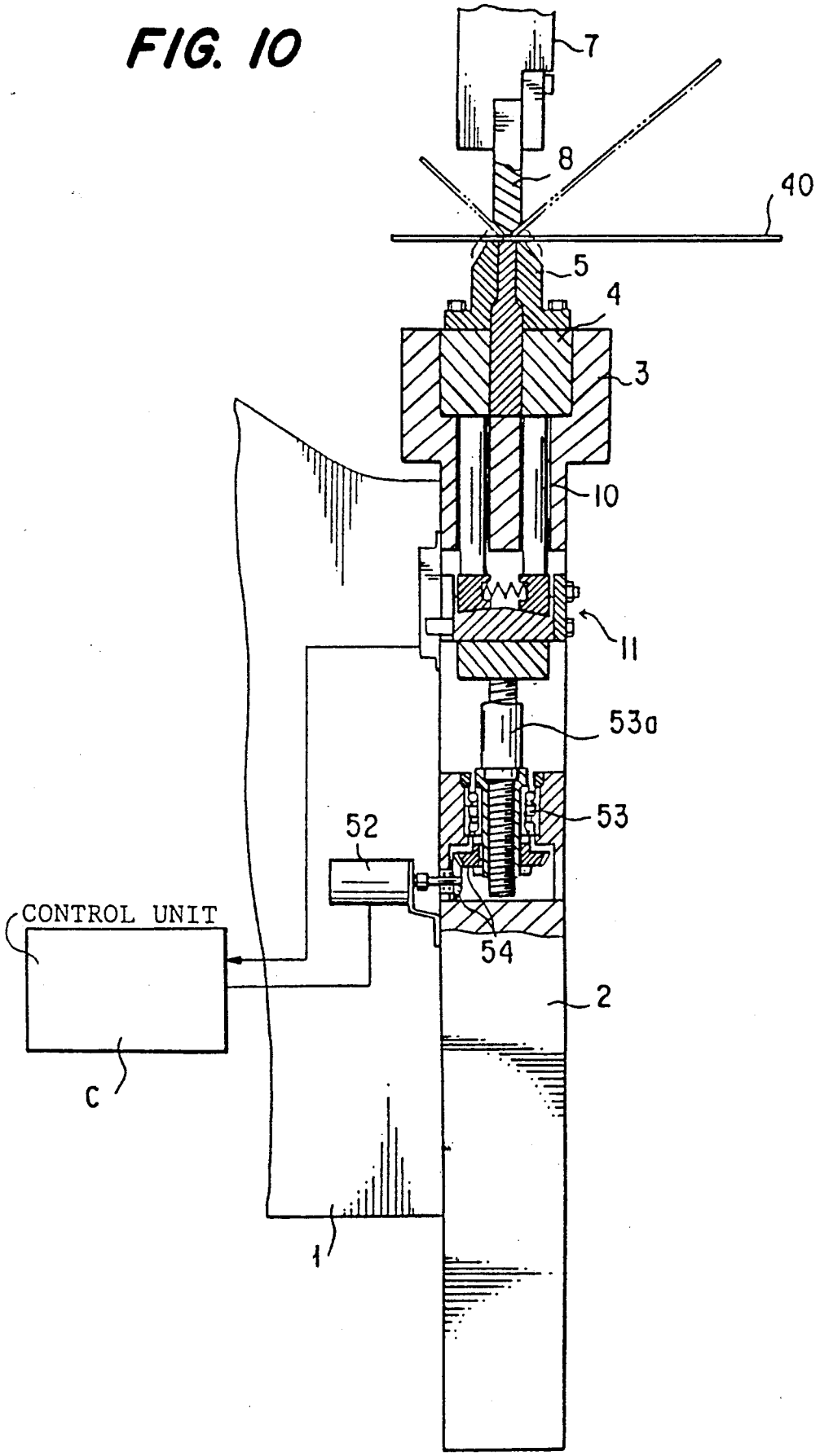

In addition, in a third embodiment of the present invention shown in FIG. 10, each of the bending hydraulic cylinders 12 is replaced with a recirculating ball nut/screw assembly 53 which is constructed of a recirculating ball nut 53*a* and a screw threadably engaged therewith. The recirculating ball nut 53*a* of the assembly 53 is rotatably driven by a servo motor 52 through a pair of bevel gears 54 on the basis of a control signal issued from the control unit C, so that the screw threadably engaging with the ball nut 53*a* of the assembly 53 moves upward as the ball nut rotates to move the movable die 5 upward.

I claim:

1. A tool position controller of a bending machine comprising:

a die having an upper portion divided into two pieces along a longitudinal direction of said die to form a groove between said two pieces;

a pair of pins each connected with a respective one of said two pieces of said die through a respective die base to transmit a pushing-up force to said die said pins each having a lower end and an upper end which is connected to said respective die base;

die push-up means provided under said die and under said pins along the longitudinal direction of said die for providing a pushing-up force to lift said pins and thereby said die in an upwardly direction, said die-push-up means includes pin height control means for controlling the height of said pins;

said pin height control means includes a pair of upper wedges each abutting said lower end of a respective one of said pins, a lower wedge having a pair of planar inclined surfaces each one for supporting a respective one of said upper wedges, screw means for adjusting a distance between said upper wedges and spring means for urging said upper wedges away from each other so that a height of said die may be adjusted by screwing or unscrewing said screws means to correspondingly move said upper wedges up or down said planar inclined surfaces;

feed quantity control means connected to said die push-up means for controlling a feed quantity of said die push-up means on the basis of working conditions previously inputted to said tool position controller, said feed quantity means includes servo means and a control unit for contolling said sevo means; and a punch and a counter sheet-metal support with at least one piece of work clamped therebetween under pressure, with said counter sheet-metal support being interposed between said two pieces of said die, said punch being fixedly mounted on a front end of a ram movable upwardly and downwardly by a pressure applying/holding hydraulic cylinder, and said die being liftable by said die push-up means so that said piece of work may be subjected to a bending operation by relative movement between said punch and said die.

2. The tool position controller of the bending machine as set forth in claim 1, wherein;

said servo means includes:

a servo valve interposed between a bending hydraulic cylinder, which is connected to said die push-up means, and a hydraulic pressure supply source;

a feed quantity control screw for operating said servo valve;

a sevo motor for rotatably driving said feed quantity control screw; and said control unit operates said servo motor on the basis of working conditions previously inputted to said control unit.

3. The tool position controller of the bending machine as set forth in the claim 1, wherein:

said servo means includes:

a servo valve interposed between a bending drive means, which is connected to said pushs-up means, and a hydraulic pressure supply source for activating said bending drive means to move said die upwardly toward said punch; and said control unit operates said servo valve.

4. A tool position controller of a bending machine comprising:

a die having an upper portion divided into two pieces along a longitudinal direction of said die to form a groove between said two pieces;

die push-up means provided under said die in at least one position along the longitudinal direction of said die for pushing up the die, said push-up means includes a pair of pins each hanging a lower end and an upper end which is connected with said die through a respective die base to transmit a pushing-up force to said die and a height control mechanism for controlling the heights of said pins, said height control mechanism being provided of said lower end of each of said pins; and feed quantity control means connected to said die push-up means for controlling a feed quantity of said die push-up means on the basis of working conditions previously inputted to said tool position controller, said feed quantity control means includes an electric servo motor, a control unit for controlling said electric servo motor, a recirculating ball nut rotatably driven by said electric servo motor through a pair of bevel gears and a screw threadably engageable with said recirculating ball nut, said screw being moveable upwardly and downwardly as said recirculating ball nut rotates while provided with an upper end abutting on a lower end of said height control mechanism;

whereby at least one piece of work may be clamped between a punch and a counter sheet-metal support under pressure, said counter sheet-metal support being interposed between said two pieces of said die, said punch being fixedly mounted on a front end of a ram movable upwardly and downwardly by a pressure applying/holding hydraulic cylinder, and said die being liftable by said die push-up means so that said piece of work may be subjected to a bending operation by relative movement between said punch and said die.

5. A tool position controller of a bending machine comprising:

a die having an upper portion divided into two pieces along a longitudinal direction of said die to form a groove between said two pieces;

die push-up means provided under said die in at least one position along the longitudinal direction of said die, said push-up means includes a pair of pins each having a lower end and an upper end which is connected with said die through as respective die base to transmit a pushing-up force to said die, height control mechanism for controlling said pins in height, said height control mechanism being provided at said lower end of each of said pins, and a bending hydraulic cylinder provided with a piston rod connected with a piston slidably mounted in a cylinder of said bending hydraulic cylinder so as to be moveable upwardly and downwardly, said bending hydraulic cylinder being connected with a lower end of said height control mechanism through said piston rod thereof while controlled in hydraulic pressure applied thereto by said feed quantity control means; and said height control mechanism abutting on said lower end of each of said pins, said height control mechanism includes a pair of upper wedges away from each other by a compressing spring, a lower wedge for supporting said supper wedges on an upper surface having a pair of inclined planar surfaces intersecting at a central portion of said lower wedge and forming the highest portion of said lower wedge, a pair of side plates each fixedly mounted on each opposite side surfaces of said lower wedge and a pair of adjusting screws each threadably engaged with each side plate disposed outside said upper wedges so as to pass through each of said side plates and each of said adjusting screws having a front end abutting on an outer surface of each of said upper wedges disposed inside said side plates; and feed quantity control means connected to said die push-up means for controlling a feed quantity of said die push-up means on the basis of working conditions previously inputted to said tool position controller;

whereby at least one piece of work may be clamped between a punch and a counter sheet-metal support under pressure, with said counter sheet-metal support being interposed between said two pieces of said die, said punch being fixedly mounted on a front end of a ram moveable upwardly and downwardly by a pressure applying/holding hydraulic cylinder, and said die being liftable by said die push-up means so that said piece of work may be subjected to a bending operation by relative movement between said punch and said die.

6. The tool position controller of the bending machine as set forth in claim 5, wherein said feed quantity control means includes a servo valve interposed between said bending hydraulic cylinder and a hydraulic pressure supply source, a feed quantity control screw for operating said servo valve, a servo motor for rotatably driving said feed quantity control screw, and a control unit for operating said servo motor on the basis of working conditions previously inputted to said control unit.

7. The tool position controller of the bending machine as set forth in claim 6, wherein said feed quantity control means includes an electro hydraulic servo valve interposed between said bending hydraulic cylinder and a hydraulic pressure supply source and a control unit for operating said electro hydraulic servo valve.

* * * * *